US006041960A

United States Patent [19]

Leal

[11] Patent Number: 6,041,960

[45] **Date of Patent: *Mar. 28, 2000**

[54] CONNECTION ASSEMBLY FOR PREVENTING LOSS OF GARBAGE CAN COVER

[76] Inventor: Richard J. Leal, 38 Abbott Rd., Towaco, N.J. 07082

[ * ] Notice: This patent issued on a continued prosecution application filed under 37 CFR 1.53(d), and is subject to the twenty year patent term provisions of 35 U.S.C. 154(a)(2).

[21] Appl. No.: 09/000,701

[22] Filed: Dec. 3, 1997

[51] Int. Cl.[7] ..... B65D 55/16

[52] U.S. Cl. ..... 220/315; 215/306; 220/318; 220/375; 220/908; 292/258; 292/288

[58] Field of Search ..... 220/315, 318, 220/327, 328, 908, 730, 375; 215/306; 292/258, 288

[56] References Cited

U.S. PATENT DOCUMENTS

| | | | |
|---|---|---|---|
| 1,843,507 | 2/1932 | Elder . | |
| 1,924,242 | 8/1933 | Kaye | 215/306 |
| 2,873,880 | 2/1959 | Poulos | 220/318 |
| 2,919,946 | 1/1960 | Miener . | |
| 3,125,393 | 3/1964 | King | 292/288 |
| 3,231,901 | 2/1966 | Kennedy | 215/306 X |
| 3,291,515 | 12/1966 | Lierman | 220/318 X |
| 3,363,924 | 1/1968 | Remig | 220/318 X |
| 3,589,760 | 6/1971 | Williams | 292/258 |
| 3,674,298 | 7/1972 | Vekony | 292/258 |
| 3,817,563 | 6/1974 | McGlothlin . | |
| 3,893,725 | 7/1975 | Coulter et al. . | |
| 3,935,964 | 2/1976 | Saxe . | |
| 3,980,202 | 9/1976 | Monyak et al. . | |
| 4,043,368 | 8/1977 | Forte, Sr. | 220/908 X |
| 4,096,977 | 6/1978 | Barville et al. . | |
| 4,241,846 | 12/1980 | Murphy | 220/318 |
| 4,320,851 | 3/1982 | Montoya . | |
| 4,384,656 | 5/1983 | McQuiston et al. . | |
| 4,470,176 | 9/1984 | Vermeulen et al. . | |
| 4,473,170 | 9/1984 | Ciancimino . | |
| 4,478,348 | 10/1984 | Cook | 220/318 |
| 4,569,108 | 2/1986 | Schwab . | |
| 4,666,194 | 5/1987 | Charman | 292/288 |
| 4,955,501 | 9/1990 | Hodge . | |
| 4,976,371 | 12/1990 | Wise et al. . | |
| 5,004,114 | 4/1991 | Terbrusch et al. . | |
| 5,058,922 | 10/1991 | Long . | |
| 5,077,868 | 1/1992 | Visser . | |
| 5,078,295 | 1/1992 | Grant | 220/318 |
| 5,111,554 | 5/1992 | Sweers . | |
| 5,195,670 | 3/1993 | Piretti et al. . | |
| 5,297,692 | 3/1994 | Kronmiller | 220/318 |
| 5,367,752 | 11/1994 | Petty . | |
| 5,385,258 | 1/1995 | Sutherlin . | |
| 5,630,257 | 5/1997 | Brody et al. . | |
| 5,638,977 | 6/1997 | Bianchi . | |
| 5,687,879 | 11/1997 | King et al. | 220/318 X |

*Primary Examiner*—Stephen P. Garbe
*Assistant Examiner*—Robin A. Hylton
*Attorney, Agent, or Firm*—Anthony J. Casella; Gerald E. Hespos

[57] ABSTRACT

An assembly is provided for keeping a garbage can cover in close proximity to the garbage can. The device includes an elongate elastic cord having first and second ends. An eye-bolt is slidably disposed along the cord between the ends. The first end of the cord includes a permanent engagement structure, such as a loop. A hook or other releasable engagement is securely mounted to the second end of the cord. The device is used by securing the permanent engagement at the first end of the elastic cord to a first handle of the garbage can. The eye-bolt then is secured to the cover, and the hook at the second end of the cord is used to releasably engage the second handle. The contents of the garbage can can be accessed by removing the hook or other such releasable engagement from the second handle. The cover may then be dropped, but will remain in close proximity to the garbage can due to the attachment of the first end of the elastic cord to the can and the attachment of the eye-bolt to the cover.

4 Claims, 2 Drawing Sheets

CONNECTION ASSEMBLY FOR PREVENTING LOSS OF GARBAGE CAN COVER

BACKGROUND OF THE INVENTION

1. Field of the Invention

The subject invention relates to an apparatus for efficiently and easily keeping a garbage can cover in close proximity to the garbage can without significantly impeding access to the can.

2. Description of the Prior Art

A conventional garbage can includes a bottom wall and a open-topped side wall connected to and extending upwardly from the bottom wall. External portions of the side wall near the open top typically are provided with a pair of opposed handles to facilitate lifting and dumping of the garbage can. The prior art garbage can further includes a cover having an outwardly convex top wall and a short side wall depending downwardly from the top wall. The side wall of the cover is dimensioned and configured to telescope over the open top of the side wall of the garbage can. The cover is placed on the garbage can to provide a neat appearance, to contain undesirable odors and to limit access by animals. The cover must be removed each time a bag of garbage is added to the can and each time the can is to be emptied by a sanitation worker. Thus, the cover should be sufficiently secure to prevent inadvertent separation from the can, while still being easy to intentionally separate from the can for accessing the contents of the garbage can.

Animals, such as raccoons, are particularly adept at opening garbage cans that rely merely on the telescoping interfit of the cover with the can. These animals will separate the cover from the can and distribute the contents of the garbage can over a wide area while they are picking at the edible contents of the garbage bags. The garbage can cover, in the meantime, becomes a victim of the wind. The part top wall of most garbage can covers defines an efficient aerodynamical shape substantially resembling a Frisbee. Consequently, once separate from the can, the garbage can cover can travel a considerable distance. Garbage can covers often are run over by motor vehicles and rendered substantially useless.

To limit access by raccoons and other animals, many garbage cans include latches for releasably retaining the cover on the can. More particularly, a very popular prior art garbage can includes a circular bottom wall and a cylindrical side wall that are unitarily molded from plastic. Plastic handles are hingedly attached to the side wall near the open top of the garbage can. The handles are molded to include latch structures. This prior art garbage can cover includes a short cylindrical side wall that is molded to include ribs that can be lockingly engaged by the latch structures on the handles of the garbage can. Thus, the handles can be rotated upwardly into latched engagement with the short cylindrical side wall of the garbage can cover to prevent inadvertent separation of the cover from the can. Prior art garbage cans of this type typically are raccoon proof. However, home owners often neglect to properly latch the cover onto the can. Furthermore, a very full garbage can often cannot be properly latched. Thus, raccoons often are capable of removing the cover of a garbage can and permit the cover to be wind blown a considerable distance from the can.

Sanitation workers also are responsible for lost or damaged garbage can covers. In this regard, sanitation workers typically are very rushed. Thus, the garbage can cover is removed and tossed to the ground near the can. The can then is dumped into the garbage truck, and the empty can is placed back on the ground near the cover. Garbage cans are fairly large and heavy, and therefore are not likely to be windblown. However, as noted above, the light weight aerodynamically shaped garbage can cover often will be blown into a street before the home owner has the opportunity to affix the cover back on the can.

Trash is picked up two times per week at many suburban locations. Thus, the garbage can cover will be tossed free of the garbage can at least twice each week. In many areas, the garbage cans must be placed at or adjacent the curb on the days of garbage pick up. Additionally, in many locations the residents of a home will have left for work or school before the garbage has been picked up. Thus, the garbage can cover will lie separated from the can and near the curb for most of two days each week. This considerable duration increases the probability that the garbage can cover will be blown into the nearby street and permanently damaged or lost. Furthermore, even on a windless day, the separated garbage can and garbage can cover are unsightly.

The prior art includes many attempts to keep a garbage can cover on or near the can. For example, U.S. Pat. No. 3,893,725 shows a pair of straps for use with a garbage can and cover. One end of each strap includes a latch for engaging each of the two handles on the garbage can. The opposed ends of the straps include releasably engageable Velcro connections. The Velcro connections can be separated to access the garbage can and can be secured to one another for holding the garbage can cover on the can. An attachment of this type may be effective for preventing access by raccoons. However, sanitation workers must separate the Velcro connections to access the cans. Sanitation workers cannot be relied upon to reaffix the Velcro connection.

U.S. Pat. No. 3,980,202 shows a strap having a pair of D-rings on the opposed ends. One D-ring is connected to the handle on the garbage can, while the opposed D-ring is connected to the handle on the cover. A strap of this type would have no effect on limiting access by raccoons or other such animals. Additionally, most garbage cans currently are molded from plastic, and the covers do not include a handle to which a D-ring could be affixed.

U.S. Pat. No. 4,473,170 shows a garbage can cover that is threadedly engageable with the top of the garbage can. The garbage can cover includes a handle at a top central position. An eye bolt is passed through the handle and is threadedly engaged thereon. The cable is then passed through the eye bolt and opposed ends of the cable are permanently connected to the handles of the garbage can. The cable includes enough slack to permit the threaded engagement and disengagement of the cover. Additionally, the cable includes enough slack to prevent separation of the cover from the garbage can after the cover and can have been threadedly separated. In this instance, the cable does not function to hold the cover on the can for purposes of preventing access by animals. Rather, the cover relies upon the threaded interconnection to the can for preventing access by animals. Thus, the cable merely functions to prevent the cover from being separated and blown away from the cover.

U.S. Pat. No. 4,976,371 shows a first belt that is wrapped circumferentially around the garbage can at a location beneath the handles. This circumferential strap includes a pair of Velcro-type connectors diametrically opposite positions thereon. A second strap is then secured over the cover. This second strap has Velcro-type connectors at opposite ends that are secured to the diametrically opposite Velcro-type connectors on the circumferential strap for holding the cover on the can. However, this combination of straps does not function to prevent separation of the cover on the can.

U.S. Pat. No. 5,004,114 shows a garbage can and cover assembly where the cover is threadedly engageable with the can. The cover is retained in close proximity to the can by a pair of hingedly connected arms. One arm is hingedly connected to the side wall of the garbage can, while the second arm is pivotally engaged with a central position on the cover. This pivoted connection permits the unthreading of the cover, while the other hinged connections of the arms permits the cover to be rotated away from the can. This assembly does not function to keep the cover on the can. Rather, the cover and can must rely upon their threaded interconnection. As a result, this complex hinged arrangement would be substantially useless on most garbage cans that do not have threaded interengagement of the cover and the can.

Other complex garbage can connection assemblies are shown in U.S. Pat. Nos. 3,935,964, 4,320,851, 4,384,656 and 4,470,176. Each of these garbage can and cover assemblies include cover retention mechanisms that are complex and that require specially manufactured covers for cans or complexly retrofitted covers and cans.

In view of the above, it is an object of the subject invention to provide an inexpensive assembly that can be used to securely hold a cover on a can and to keep the cover in close proximity to the can after the contents of the can have been accessed.

It is another object of the subject invention to provide a garbage can and cover retention assembly that can be used with virtually any plastic garbage can.

An additional object of the subject invention is to provide a garbage can and cover retention assembly that does not significantly impede access to the garbage can by humans.

A further object of the invention is to provide a garbage can cover retention device that can be attached easily to a garbage can and/or cover by a layman using simple hand tools.

SUMMARY OF THE INVENTION

The subject invention is directed to an assembly for selectively and releasably holding a garbage can cover on a garbage can and for substantially preventing the garbage can cover from being separated from the garbage can after the garbage can has been opened. The assembly includes an elongate elastic cord having first and second ends and having a selected cross-sectional size. The device further includes an eye-bolt having opposed first and second ends. The first end of the eye-bolt is threaded. At least one washer may be slidably positioned over the threaded end of the eye-bolt, and a nut may be threadedly engaged thereon. The second end of the eye-bolt is formed to define an aperture having cross-sectional dimensions greater than the cross-section of the elastic cord. The elastic cord is passed through the aperture in the eye-bolt.

The first end of the elastic cord is provided with a substantially permanent retention means. Preferably, the permanent retention means is defined by a permanently enclosed loop that is sufficiently large to receive the cord and the eye-bolt therethrough. Thus, the elastic cord can be looped around another structure and secured thereto by passing the second end of the elastic cord, including the releasable retention means thereon, through the permanent loop at the first end of the elastic cord. The substantially permanent retention means may alternatively define a releasably closable clip, such as a D-ring.

A releasable gripping means is securely mounted to the second end of the elastic cord. The releasable gripping means may merely define a hook securely engaged with the second end of the elastic cord. The hook may be a metal member and may be coated with a thermoplastic material. Alternatively, the hook may be formed entirely from plastic. Alternatively, the releasable retention means on the second end of the elastic cord may define a latched hook with an easily openable spring-biased latch.

The assembly of the subject invention is employed by permanently securing the first end of the elastic cord to a first handle of the garbage can. With the preferred embodiment, this connection of the elastic cord to the first handle is achieved by first looping the elastic cord around the first handle and then passing the second end of the cord through the closed loop at the first end of the cord. The cord is pulled tight, such that the first end of the cord is securely retained on the handle. In embodiments of the device having a clip secured to the first end, it is merely necessary to secure the clip to the first handle.

Many prior art plastic garbage cans include a cover having a centrally disposed aperture that is closed by a plastic plug. This plug may be punctured or removed by striking a blow on the plug with a hammer and screw driver or by prying the plug free with the end of a screw driver. The eye-bolt then is secured to the aperture in the cover of the garbage can at the aperture. This is accomplished by threadedly disengaging the nut and removing the washers. The threaded end of the eye-bolt then is passed through the aperture in the garbage can cover. The washers then are positioned over the threaded end of the eye-bolt, and the nut is threadedly engaged thereon. Garbage cans that do not have the removable plug, at the center of the cover merely require a hole to be drilled through the cover. Attachment of the eye-bolt then proceeds as described above.

The assembly is used by merely placing the garbage can cover on the opened top end of the prior art garbage can in the conventional manner. The second end of the elastic cord is then stretched such that the hook or other such releasable connection means is releasably attached to the second handle that is diametrically opposite the first handle to which the first end of the elastic cord is permanently attached. The assembly thus securely holds the garbage can cover on the open top of the garbage can. The garbage can may be accessed by merely disengaging the releasable retention means, such as the plastic or plastic coated hook, from the second handle of the garbage can. The garbage can cover is then telescoped out of engagement with the garbage can in the conventional manner. The person opening the garbage can may then merely drop the garbage can cover. The cover will remain in close proximity to the garbage can in view of the substantially permanent connection of the first end of the elastic cord to the first handle of the garbage can and in view of the slidable mounting of the eye bolt along the cord and the substantially permanent retention of the cover on the eye-bolt.

The cover may be replaced on the garbage can by merely sliding the cover and the eye-bolt along the elastic cord sufficiently for the cover to be telescoped onto the open top of the garbage can. The cord then is pulled through the eye-bolt and is stretched sufficiently to permit the releasable connection means, such as the hook, to be releasably connected to the second handle.

Some garbage cans have only one handle that is rotatable into detached engagement with the cover. For these situations, it may not be necessary to permanently keep the garbage can cover in close proximity to the garbage can. Thus, for these situations, the first end of the elastic cord may have a second threaded eye-bolt secured thereto. More particularly, the first end may be looped through the aperture in the eye-bolt and may be secured to a location on the elastic cord between the ends and in proximity to the first end. A hole may be drilled through the side wall of the garbage can at a location diametrically opposite the one handle. The combination of the second eye-bolt and associated washers and nut may be employed to secure the second end of the elastic cord to the garbage can at the hole opposite the handle. In this embodiment, the cover of the garbage can is removed by initially separating the releasable attachment means, such as the hook, from the one garbage can handle. The garbage can cover then is removed, and the cover is merely dropped. The connection between the second eye bolt and the garbage can then will keep the cover near the can as described above.

DETAILED DESCRIPTION OF THE PREFERRED EMBODIMENTS

Figure 1:
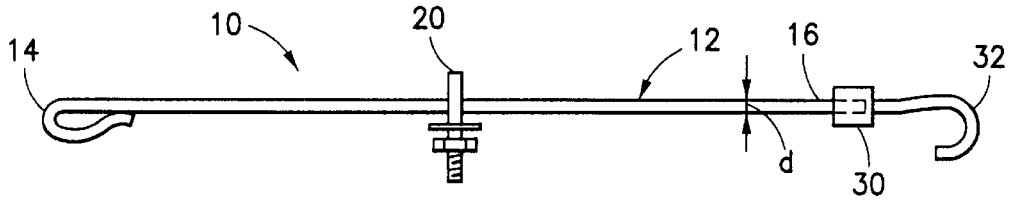
FIG. 1 is an elevational view of a garbage can cover retention assembly in accordance with the subject invention.
Figure 2:
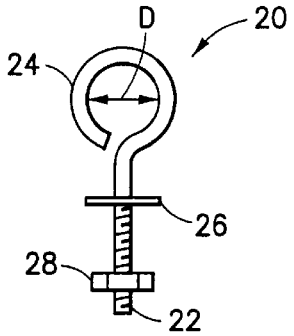
FIG. 2 is an elevational view of the eye bolt of the assembly.
Figure 3:
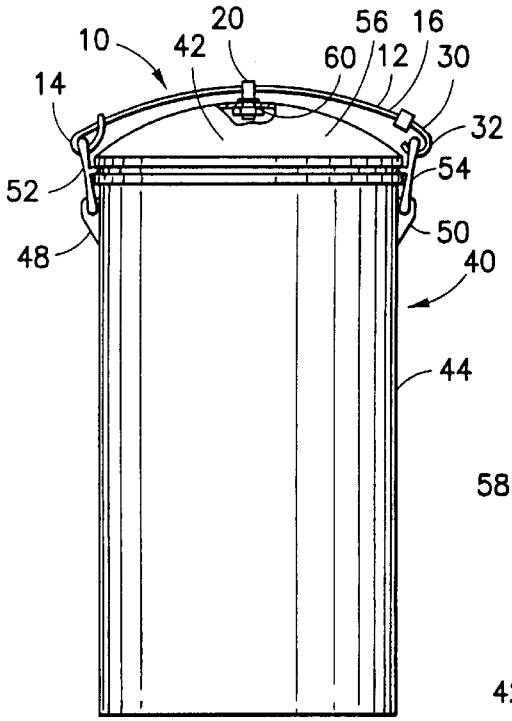
FIG. 3 is a side elevational view of the assembly mounted to a garbage can and cover and with the cover in the closed condition on the garbage can.
Figure 4:
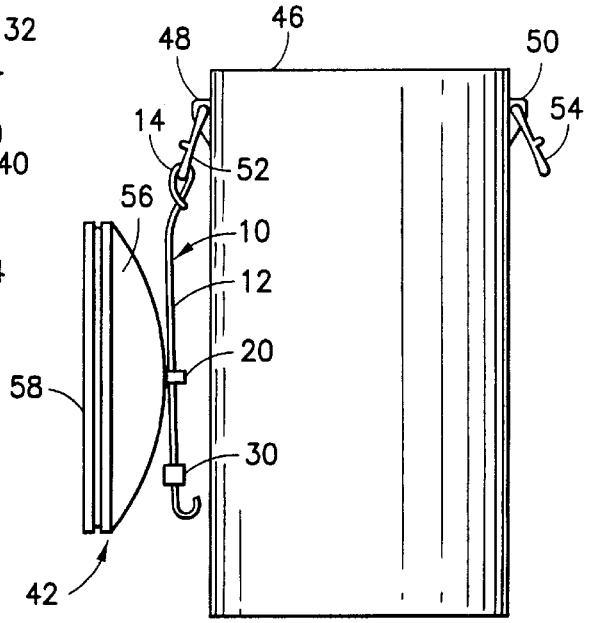
FIG. 4 is a side elevational view similar to FIG. 3, but showing the cover removed from the open top of the garbage can.

The garbage can cover retention assembly in accordance with the subject invention is identified generally by the numeral 10 in FIGS. 1 and 2. The assembly 10 includes an elongate elastic cord 12 having a first end 14, a second end 16 and a substantially uniform diameter "d" at all locations between the ends 14 and 16. An eye-bolt 20 is mounted to the elastic cord 12. More particularly, as shown most clearly in FIG. 2, the eye-bolt 20 includes opposed first and second ends 22 and 24 respectively. The first end 22 is provided with an array of external threads thereon. A plurality of washers 26 are slidably mounted over the first end 22 and are positioned between the respective ends 22 and 24. A nut 28 then is threadedly engaged on the first end 22 of the eye-bolt 20. The second end 24 of the eye-bolt 20 is formed to define an aperture 29 of diameter "D" which is slightly greater than the diameter "d" of the elastic cord 12. Thus, the eye-bolt 20 can be slid along the length of the elastic cord 12.

The first end 14 of the elastic cord 12 defines a permanently enclosed loop achieved by securely and permanently affixing an end of the elastic cord 12 into secure engagement with portions of the elastic cord 12 slightly spaced from the end. This connection may be achieved by threaded attachment, by constriction with a coil-spring or by crimping with a staple-like device. The loop defined at the first end 14 of the elastic core 12 preferably is sufficiently large for permitting the eye-bolt 20 and other parts of the assembly 10 to be passed therethrough.

A hook 30 is securely and substantially permanently mounted to the second end 16 of the elastic cord 12. The hook 30 may be formed from a metal material that may be coated with plastic for substantially preventing metal portions of the hook from rusting. Alternatively, the hook 30 may be molded entirely from plastic. The portion 32 of the hook 30 remote from the elastic cord 12 are of substantially J-shape and are dimensioned for releasable engagement with a handle of a garbage can as explained further herein.

The assembly 10 is employed with a garbage can 40 and a garbage can cover 42. The garbage can 40 includes a substantially cylindrical side wall 44 with a substantially circular bottom wall extending unitarily across a bottom end of the cylindrical side wall 44. The top end 46 of the cylindrical side wall 44 is substantially opened. The garbage can 40 further includes first and second handle mounts 48 and 50 respectively which are unitarily molded near the open top 46 of the garbage can 40. First and second handles 52 and 54 respectively are pivotably engaged on the first and second handle mounts 52 and 54 for hinged movement relative thereto.

The cover 42 includes a part spherical top wall 56 and a short cylindrical side wall 58 dimensioned to telescope over the open top 46 of the garbage can 40. The spherically generated top wall 56 includes a central aperture 60 therein. As noted above, the aperture 60 may be formed by merely removing a plastic plug provided on many prior art garbage cans as part of the manufacturing process. Alternatively, a hole can be drilled through the top at a selected location. The hole 60 need not be at the center of the garbage can cover 42.

The assembly 10 is used with the garbage can 40 and cover 42 by initially looping the elastic cord 12 around the first handle 52 and by then passing the second end 16 of the elastic cord 12 through the loop at the first end 14. This involves urging the hook 30 and the eye-bolt 20 through the loop at the first end 14 of the elastic cord 12. The elastic cord 12 then is pulled tight such that the first end 14 of the elastic cord 12 is securely held on the first handle 52.

The eye-bolt 20 then is affixed securely to the cover 42 at the hole 60. More particularly, the nut 28 and washers 26 of the eye-bolt 20 are removed temporarily, and the second end 22 of the eye-bolt 20 is passed through the hole 60 in the cover 42. The washers 26 then are slid over the threaded end of the eye-bolt 28, and the nut 26 is threaded thereon. Thus, the cover 42 is substantially permanently connected to the garbage can 40. However, the eye-bolt 20 can be slid to any selected position along the elastic cord 12 to effect relative movement between the cord 12 and the cover 42.

Use of the assembly 10 proceeds by stretching the elastic cord 12 sufficiently for the end 32 of the hook 30 to be releasably engaged with the second handle 54. In this manner, the assembly 10 helps prevent inadvertent separation of the cover 42 from the garbage can 40.

Contents of the garbage can 40 may be accessed by expanding the elastic cord 12 sufficiently to disengage the curved portion 32 of the hook 30 from the second handle 54. The cover 42 then may be removed in the conventional manner and may be dropped adjacent the garbage can 40. This release of the cover 42 will permit the cover 42 to merely drop in proximity to the garbage can in view of the attachment of the assembly 10 with both the garbage can 40 and the cover 42.

Figure 5:
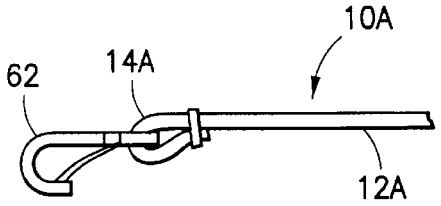
FIG. 5 is an elevational view of a portion of a second embodiment of the assembly.

A second embodiment of the assembly is identified by the numeral 10A in FIG. 5. The second embodiment 10A differs from the first embodiment only in that the first end 14A of the elastic cord 12A does not define a permanently enclosed loop as in the previous embodiment. Rather, a clip 62 is securely and permanently affixed to the second end 16A. The clip 62 may be opened to initially mount the second end 16A onto the second handle 54 of the garbage can 40. Other aspects of the second embodiment may be identical to those described above.

Figure 6:
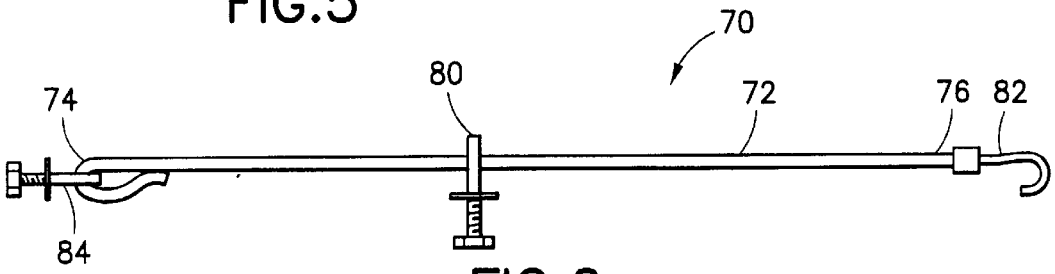
FIG. 6 is an elevational view of a third embodiment of the assembly.
Figure 7:
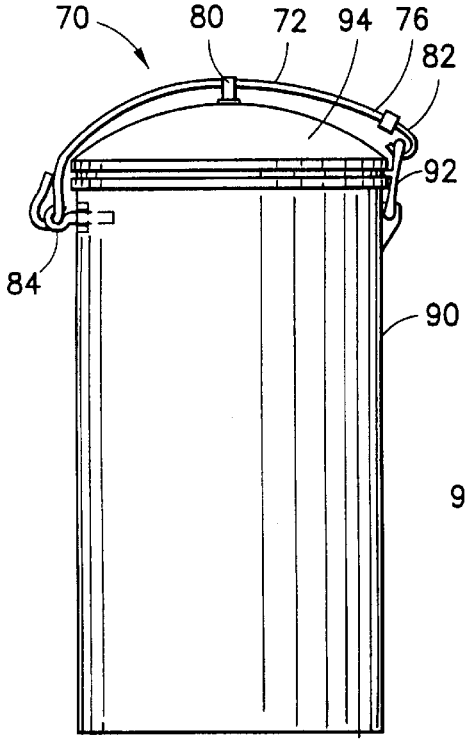
FIG. 7 is a side elevational view similar to FIG. 3, but showing the third embodiment.
Figure 8:
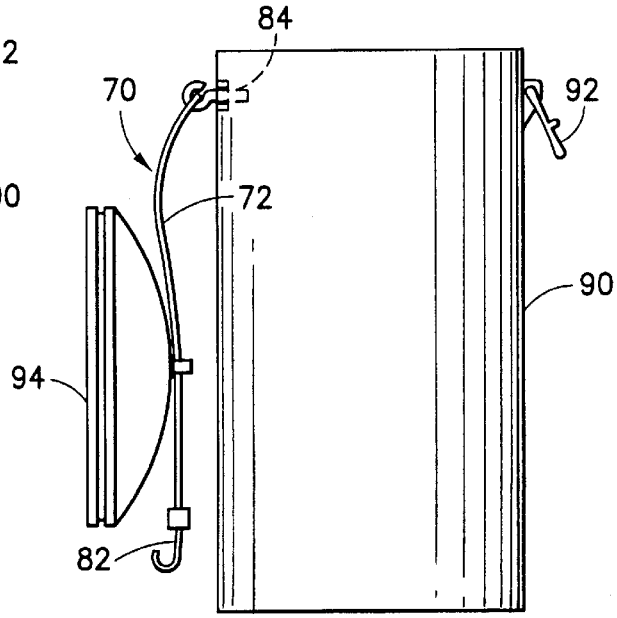
FIG. 8 is an elevational view similar to FIG. 4, but showing the third embodiment.

A third embodiment of the subject assembly is identified generally by the numeral 70 in FIGS. 6–8. The device 70 include an elastic cord 72 having opposed first and second ends 74 and 76 substantially as described above. Additionally, the assembly 70 includes an eye-bolt 80 slidably engaged along the elastic cord 72. A hook 82 is securely and permanently mounted to the second end 76 of the elastic cord 72 substantially as with the first embodiment. However, the first end 74 of the elastic cord 72 has a second eye-bolt 84 securely and permanently mounted thereto. The second eye-bolt 84 is substantially identical to the first eye-bolt 80.

The device 70 of FIGS. 6–8 is employed with the garbage can 90 having only one handle 92 for latching the cover 94. In this embodiment, the second eye-bolt 84 is secured to the garbage can 90 by drilling a hole through the side wall of the garbage can 90 at a location opposite the one handle 92 and by employing the nuts and washers of the second eye-bolt 84 substantially in the manner described above with respect to the attachment of the eye-bolt to the garbage can cover 42. The first eye-bolt 80 then is affixed to the cover 94 substantially in the manner described above and the hook 82 is employed as described above to releasably engage the one handle 92 of the garbage can 90. The contents of the garbage can may be accessed by merely separating the hook 82 from the one handle 92. The cover 94 then may be dropped. As depicted in FIG. 8, the garbage can cover 94 will remain attached to the device 70 and in close proximity to the garbage can 90.

While the invention has been described with respect to several preferred embodiments, it is obvious that various changes can be made without departing from the scope of the invention as defined by the appended claims.

What is claimed is:

1. A garbage can assembly comprising:

a garbage can having a bottom wall, a side wall extending upwardly from said bottom wall and an open top, first and second handles pivotally secured at diametrically opposite positions on said side wall in proximity to said open top;

a cover having a top wall with an aperture formed therethrough and having a side wall extending downwardly from the top wall, the sidewall being in removable non-rotational telescoped engagement over portions of said side wall of said garbage can in proximity to said open top;

an eye-bolt having opposed first and second ends, portions of said eye-bolt in proximity to said first end being threaded and extending through the aperture in said top wall of said cover, said second end of said eye-bolt having an aperture extending therethrough with a selected inside diameter, said second end of said eye-bolt defining a maximum outside cross-sectional dimension;

a nut threadedly attached to the first end of the eye-bolt such that the eye-bolt is securely affixed to the cover;

an elastic cord having opposed first and second ends, portions of said elastic cord intermediate said first and second ends having a uniform diameter slightly less than the inside diameter of the aperture through the eye-bolt, said cord being slidably engaged in said aperture of said eye-bolt, said first end of said elastic cord being securely affixed to portions of said elastic cord between said ends to define a permanently enclosed loop, said loop having inside cross-sectional dimensions greater than the maximum outside cross-sectional dimension of the eye-bolt;

a hook permanently engaged on said second end of said elastic cord, said hook having cross-sectional dimensions greater than the aperture of the eye-bolt to prevent passage of said hook through said aperture of said eye-bolt, said hook further being cross-sectionally smaller than the loop to permit passage of said hook through said loop adjacent said second end of said elastic cord and being releasably engaged with said second handle of said garbage can; and the loop at the first end of the elastic cord being passed through the first handle of the garbage can, said hook, said eye-bolt and portions of said elastic cord spaced from said loop being passed through said loop such that said elastic cord is securely attached to said first handle of said garbage can, the elastic cord having a length for permitting the releasable engagement of said hook with said second handle of said garbage can upon stretching of said elastic cord, whereby said elastic cord and said hook retain said cover in telescoped engagement over said open top of said garbage can, and whereby said elastic cord, said eye-bolt and said hook maintain said cover in proximity to said garbage can when said cover is not telescoped over said open top of said garbage can.

2. The garbage can assembly of claim 1, wherein said hook comprises a clip member for releasable locking of said hook to said second handle of said garbage can.

3. The garbage can assembly of claim 1, wherein said hook is formed from a metal material coated with plastic.

4. The garbage can assembly of claim 1, wherein said hook is formed from plastic.

* * * * *